United States Patent [19]

Bussey, Jr.

[11] 4,027,064

[45] May 31, 1977

[54] LOOSE FILL PACKING ELEMENT AND METHOD OF MAKING SAME

[76] Inventor: Harry Bussey, Jr., P.O. Box 115, Serpentine Road, Navesink, N.J. 07752

[22] Filed: Apr. 30, 1976

[21] Appl. No.: 682,056

Related U.S. Application Data

[63] Continuation of Ser. No. 545,568, Jan. 30, 1975, abandoned.

[52] U.S. Cl. ..... 428/357; 206/523; 260/2.5 E; 264/51; 428/174; 428/542

[51] Int. Cl.[2] ..... B32B 1/00; B32B 3/00

[58] Field of Search ..... 428/174, 542, 357, 369, 428/156; 206/521, 523, 814; 264/51; 260/2.5 E

[56] References Cited

UNITED STATES PATENTS

| | | | |
|---|---|---|---|
| 3,188,264 | 6/1965 | Holden | 428/33 |
| 3,251,728 | 5/1966 | Humbert et al. | 428/369 |
| 3,400,037 | 9/1968 | Sare et al. | 206/521 |
| 3,481,455 | 12/1969 | Graham et al. | 206/521 |

*Primary Examiner*—George F. Lesmes
*Assistant Examiner*—P. J. Thibodeau
*Attorney, Agent, or Firm*—Kenyon & Kenyon Reilly Carr & Chapin

[57] ABSTRACT

The loose fill packing elements in one embodiment are constructed of a generally block C-shape and are of substantially uniform thickness throughout. Each of the elements has a central section to define an included angle of greater than 90°. The elements are made of any suitable expandable thermoplastic material which has resilient characteristics. The shape of the elements allows the elements to be readily flowable when being dumped into a shipping carton while also effecting an efficient nesting relationship when in place about an item being shipped in the carton.

In another embodiment, the packing elements have the end sections splayed outwardly from the central sections.

16 Claims, 10 Drawing Figures

LOOSE FILL PACKING ELEMENT AND METHOD OF MAKING SAME

This is a continuation of U.S. patent application Ser. No. 545,568 filed Jan. 30, 1975, now abandoned.

This invention relates to a loose fill packing element and particularly to elements which are used to insulate articles in shipping containers against damage from vibration and impact forces.

As in known, there are various types of loose fill materials on the market. These materials are generally made of expandable or expanded thermoplastic material and have been formed with various shapes. In some cases, the elements have been made of small collapsible cylinders such as described in U.S. Pat. No. 3,074,543, of elongated H-shape or Y-shape cross-section as described in U.S. Pat. No. 3,188,264 and as various random shapes as described in U.S. Pat. No. 3,251,728.

The intent of such loose fill materials is to provide a cushion so that an item being transported is protected against heavy or severe impacts or vibrations. However, in many cases the elements frequently migrate within a shipping carton, especially where the elements are of linear shape, to such an extent that the packaged item shifts to one side wall of the carton and becomes subject to damage. In order to overcome this problem, packaging elements have been made with random shapes. However, while some interlocking has been achieved, a problem arises with respect to the flowability of such into a shipping container during a packaging operation. That is, where the shapes have been made in a bent configuration such as in a hook shape, the various hooks have interlocked with each other during flow, for example, from a supply hopper and have caused a bridging effect in the hopper. This bridging effect, in essence, causes jamming at the mouth of the hopper so that elements above cannot fall from the hopper into the container. Thus, time and labor must be expended to unblock the hopper to permit flow. Further, in some cases, the packing materials have been of such shapes as to occupy a large space within a shipping carton. As this implies a correspondingly large weight, the cost of shipping has been increased.

Accordingly, it is an object of this invention to provide a loose fill packaging material which has ease of flowability when poured into a shipping container and which has an improved nesting when in place in a shipping container.

It is another object of the invention to provide a relatively inexpensive packing material.

It is another object of the invention to decrease the cost of shipping of packaged items in insulated shipping cartons.

Briefly, the invention provides a loose fill light weight packing element of expandable or expanded resilient thermoplastic material which has a central section and at least a pair of end sections. Each of the end sections extends from the central section to define an included angle of greater than 90° while the central section is linear or slightly curved. The element has a transverse cross-section of substantially rectangular shape.

In one embodiment, the sections of the packing element define a generally block C or channel shape. In another embodiment, the end sections are splayed outwardly of the central section.

The packing elements may be formed with more than one pair of end sections. For example, the packing element may be made with two pairs of end sections which extend from the central section. In this case, the cross-sectional shape is one of a pair of C-shaped blocks back-to-back. The resilient packing elements may also have the end sections of relatively short length relative to the central section.

In use, a mass of packing elements are poured from a suitable source such as a hopper into a shipping carton prior to and during packaging of an item to be shipped. During flow of the elements from the hopper into the carton, the inclined end sections of the elements permit flow of the elements over each other without interlocking. To this end, the inclined end sections are inclined to such a degree to permit sliding of one element past the other element. After the item is placed in the carton, the packing elements are poured to form a small overfill. The carton is then closed to slightly compact the packing elements by pushing down on the overfill. The elements are thus caused to nest within the carton to prevent migration of the packaged item.

The method of the invention resides in the steps of extruding a mass of granular particles of synthetic heat-expandable material containing an expanding agent into sheet-like form with a channel-shaped, that is a block C-shaped, profile, of allowing the material to expand under the heat generated during extrusion upon exiting from a suitable extruder, and of cutting the sheet-like form into a series of small discrete pieces to form packing elements. In order to improve resiliency, the sheet-like form may be heated by an external heat source prior to or after cutting. This further expands the material of the form.

The invention further provides a loose fill packing material comprising a plurality of such elements which are disposed in nesting relationship when placed in a shipping carton.

The packing element is made of a material which has a density of less than two pounds per cubic foot when expanded and generally of a material composed of any suitable heat-expandable material such as polystyrene, polypropylene and polyurethane. The expanding or blowing agent is of any suitable type such as a hydrocarbon or florocarbon blowing agent.

These and other objects and advantages of the invention will become more apparent from the following detailed description and appended claims taken in conjunction with the accompanying drawings in which:

Figure 1:
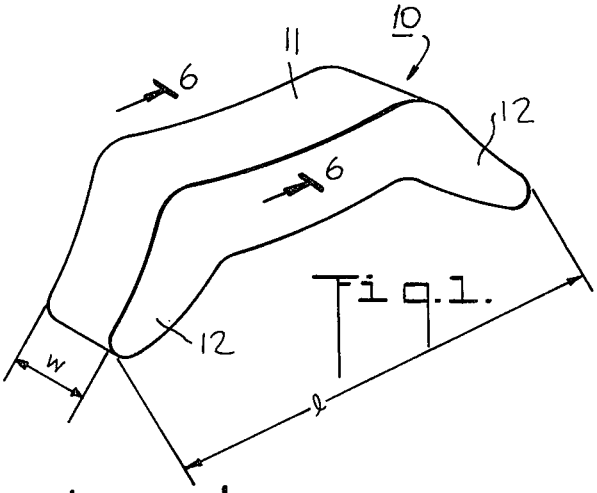
FIG. 1 illustrates a perspective view of a packing element according to the invention.

Referring to FIG. 1, the packing element 10 is formed with a central section 11 and a pair of end sections 12 which together define a generally block C-shape. As shown, each of the end sections 12 extends from the central section 11 to define an included angle of greater than 90°. For example, the end sections 12 each define an angle of 135° with the central section 11. The central section 11 is of linear shape although the central section 11 may also be of slightly curved shape with the curve extending into the mouth of the C-shaped opening defined by the end sections 12. The ends of the end sections 12 are generally of rounded configuration as viewed in cross-section. Also, as shown, the width of each element 10 is greater than the extruded length of the element 10.

Figure 6:
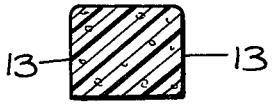
FIG. 6 illustrates a cross-sectional view taken on line 6—6 of FIG. 1.

As shown in FIG. 6, the transverse cross-section of the packing element 10 is of generally rectangular shape. In addition, the cross-section remains substantially constant throughout except near the ends of the end sections 12 where the shape becomes blunted. Due to the nature of the material from which the elements 10 are made as well as the method of manufacture, the side walls 13 of the element 10 may become slightly rounded due to the expansibility of the interior.

The packing elements 10 are made of any suitable heat-expandable thermoplastic material which has resilient characteristics. For example, the elements are made of polystyrene, polyethylene, polypropylene, and polyurethane. In addition, the resultant elements 10 are each of a density of from one-third to 2 pounds per cubic foot.

Figure 2:
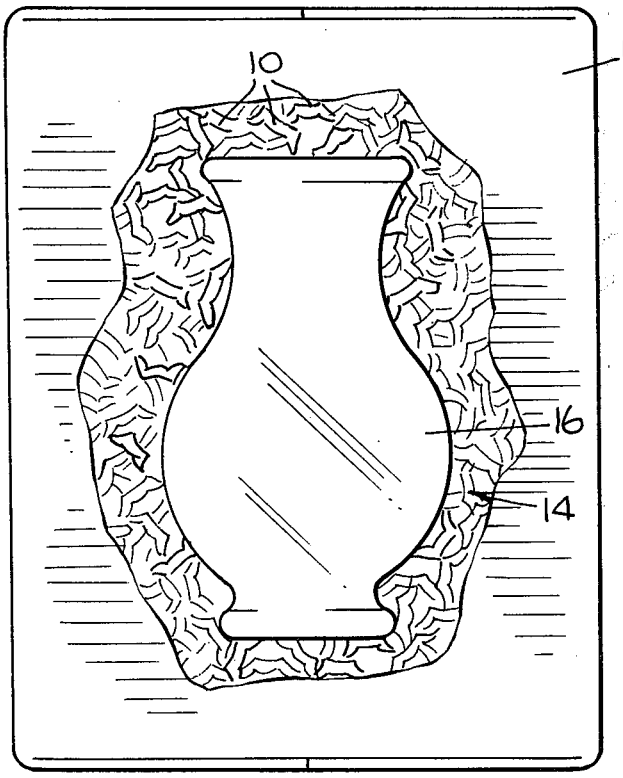
FIG. 2 illustrates a partly sectional view of a shipping carton containing an item packed with the packing material of the invention.

Referring to FIG. 2, in use, a loose fill packing material 14 made up of a plurality or mass of packing elements 10 is disposed within a shipping carton 15 to cushion an item 16 against impact or vibrational forces. As illustrated, the elements 10 are disposed in a random manner. In this manner, the various elements 10 interlock with respect to each other to dampen any forces imposed on the shipping carton 15 from without.

Figure 3:
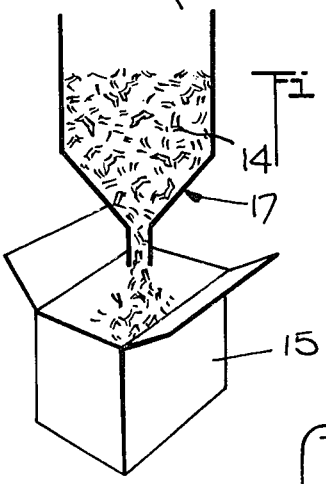
FIG. 3 illustrates a cross-sectional view of a hopper for discharging the packing material of the invention into a shipping carton.

In order to utilize the packaging material 14, the empty shipping carton 15 is initially placed below a suitable packaging material source such as a hopper 17 (FIG. 3) filled with the packaging material 14. The empty carton 15 is then opened, if not already opened, and the hopper 17 opened so as to discharge the packing material 14 into the carton 15. At the same time, or in an intermittent manner as is known, the item 16 to be packaged is also placed in the carton 15. After the packaging material 14 has filled the carton 15 to a small excess quantity so as to produce a small mound, the flow of material from the hopper 17 is stopped. The open ends of the carton 15 are then folded over in the usual manner to close the carton 15. At this time, the carton ends press the mound of elements 10 of the packing material 14 down into the carton in order to compact the elements 10 and thus cause the elements 10 to nest with respect to each other. In this way, the item 16 is prevented from migrating from the position in which the item is initially packed under an external vibration or impact force.

Figure 7:
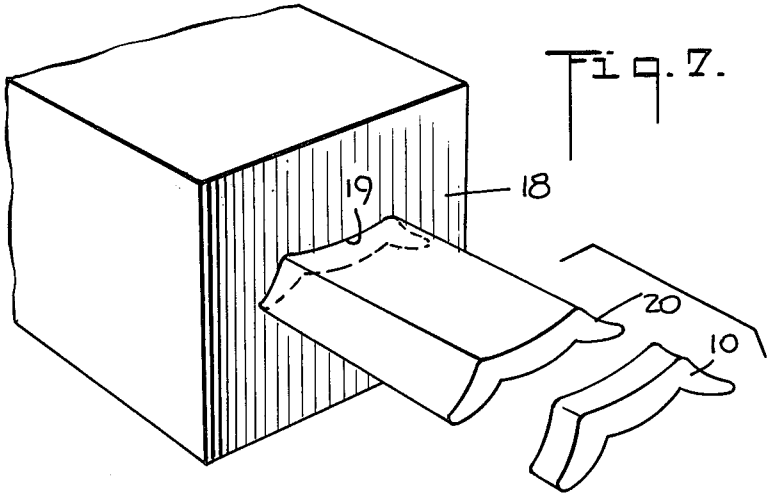
FIG. 7 illustrates a perspective view of an extruder during extrusion of a sheet-like form from which the packing material is made.
Figure 8:
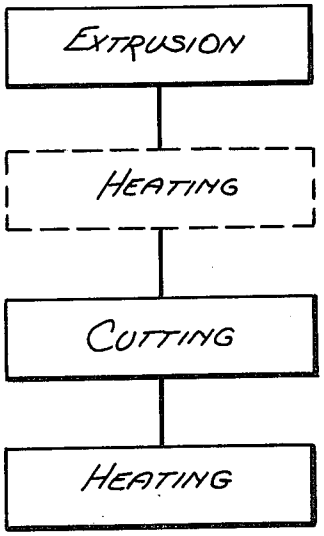
FIG. 8 illustrates a flow diagram of a method according to the invention of making the packing material.

Referring to FIGS. 7 and 8, in order to make the elements 10 of the packaging material 14, a mass of small granular particles of a suitable heat expandable synthetic material are placed in an extruder 18 (FIG. 7) with a hydro carbon blowing or expanding agent. The extruder 18 may be of any suitable type and is provided with a channel-shaped outlet 19. The process used may be generally any one of these as described, for example, in U.S. Pat. Nos. 3,074,543 and 3,188,264. During the extrusion process, heat is generated within the mass of material. Thus, as the heated material passes out of the channel shaped opening 19, the material begins to expand. The extrusion of the material continues so as to produce a sheet-like form 20 of channel-shaped or block C-shaped cross-section. The form 20 is then cut into small pieces by any suitable cutting means (not shown) transversely of the longitudinal axis of the form 20 so as to form the individual discrete elements 10. In order to improve the resiliency of the produced packaging elements 10, the sheet-like form 20 may be heated by a suitable heat source (not shown) prior to or after cutting. This will cause the expanding agent to further expand the material of the form 20.

In order to make packaging elements 10 of different shapes, the outlet 19 from the extruder 18 may be modified. For example, in order to make a shape having the shape of two block C's back-to-back, the channel shaped outlet 19 is provided with two additional flanges in an I-beam-like configuration.

Due to their shape, when the elements 10 are placed within a shipping carton, they occupy a relatively limited space. That is, the shape of the elements 10 permit small voids or air spaces to be formed therebetween. This reduces the number of elements 10 required to package an item and, in turn, reduces the overall weight of the packaging material 14 required and the weight of the shipping container. For example, for a shipping carton 15 of a size of 12 × 12 × 12 inches, without any item packaged, the total weight of packing material 14 is about 0.4 pounds whereas other materials such as excelsior, shredded urethane, polyethylene bubbles, shredded paper, chopped rubberized horse hair, etc. amount to about 0.5 to 5 pounds.

The shape of the resilient packaging elements 10 also eliminates migration of a packaged item during shipping due to the nesting characteristics of the elements 10. It is also noted that the elements when not packed tightly will flow readily for example during discharge from the hopper 17.

Figure 4:
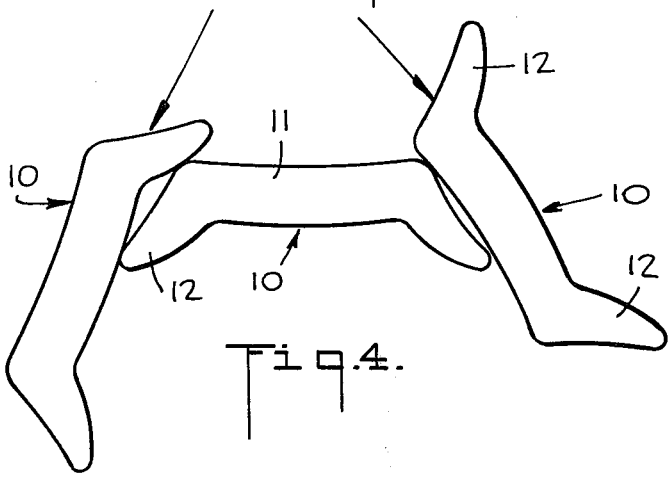
FIG. 4 illustrates a view of a plurality of discrete packing elements of the invention during descent from a hopper.

Referring to FIG. 4, when the resilient elements 10 are being discharged, for example from a hopper 17, the elements slide over each other without nesting. This is aided by the inclined end sections 12 of the elements and the broad included angle between the end sections 12 and the central sections 11 of each element. In a sense, substantially smooth continuous surfaces are provided by the discrete elements 10 over which the other elements 10 may slide.

Figure 5:
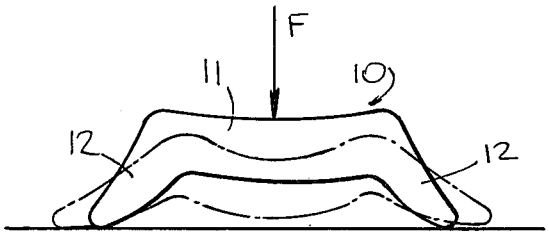
FIG. 5 illustrates a view of a packing element undergoing impact forces within a shipping carton.

Referring to FIG. 5, when the resilient elements 10 are in place within a shipping carton in a nesting relationship, the external forces imposed upon the elements cause the elements to act in the manner of a spring to some slight extent. Specifically, if an impact force F is imposed on the central section 11 of the element 10, the central section 11 bows inwardly while the end sections 12 flex outwardly to some extent. The shape of the element 10 imparts a flexibility so as to avoid breaking as may otherwise occur if sharp or extreme curves were used in the element 10. During deflection in the center section, as viewed, the end sections 12 push out to create pressure to compensate for the deflection in the top of the element 10.

Figure 9:
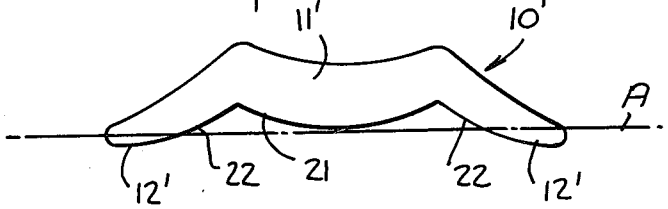
FIG. 9 illustrates a side view of a modified packing element having splayed sides according to the invention.

Referring to FIG. 9, wherein like reference characters indicate like parts as above, the packing element 10′ may be made with end sections 12′ which are splayed outwardly of the central section 11 and on the same side. The packing element 10′ is of substantially uniform width depending upon the internal forces and the cutting operation when cut from the sheet-like form as described above. The end sections 12′ are each of a thickness less than the thickness of the central section 11′; the thickness of the element being taken in the plane of the drawing as viewed. In addition, the central section 11′ has a side surface 21 which is slightly rounded and which is disposed substantially in a plane A passing through the end sections 12′. The top surface may also be slightly rounded as shown. Also, as shown, each leg 12′ may have a slightly rounded side surface 22 on the side defining the included angle with the central section 11′.

Figure 10:
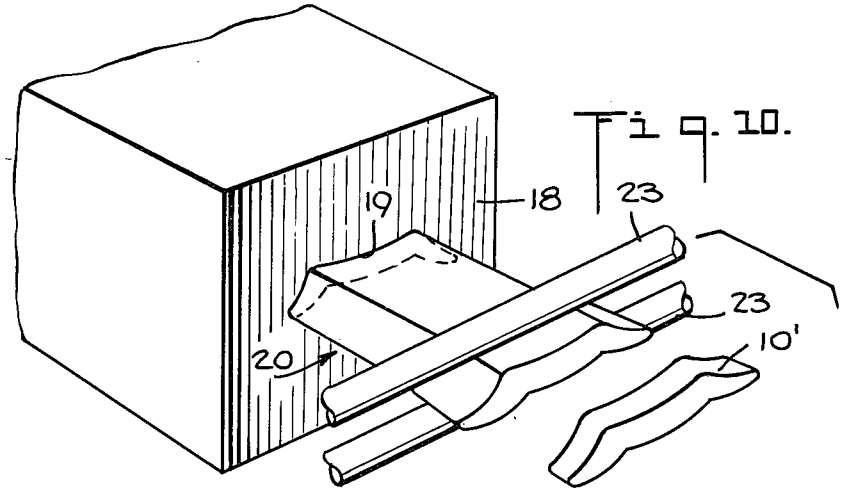
FIG. 10 illustrates a schematic view of an apparatus for making the element of FIG. 9.

Referring to FIG. 10, in order to form the packing element 10′, similar steps are carried out as described above with respect to FIG. 7. However, upon exiting of the sheet-like form 20 from the extruder 18, the form 20 passes between a pair of rollers 23 which impose forces on two opposite sides of the member 20 while the sheet member 20 is in a heated condition in order to splay the end sections outwardly of the central section. This squeezing action imparted by the rollers 23 is sufficient to splay the end sections without damaging the sheet form 20. The squeezing action is also imposed before setting of the material of the sheet form. In this way, the deformed sheet member can then be set to maintain the end sections in splayed relation to the central section.

It is to be noted that the packing element may be initially made in a latent foaming or expandable state or in an expanded state. That is, the elements may be formed by an extrusion process in which an extruded strand of the material from which the elements are made is retained in an unexpanded state. The elements severed from such a strand may be substantially heated at the site where the elements are to be used so that the elements expand. Such alternative procedures have been known, for example, as described in U.S. Pat. Nos. 3,026,273 and 3,489,455.

What is claimed is:

1. A loose fill packing element of expandable resilient thermoplastic material, said element being of generally block shape having a central section and at least a pair of end sections defining a generally block C-shape, each said end section extending from said central section to define an included angle of greater than 90 °, said element having a transverse cross-section of substantially rectangular shape and being of a width (w) greater than the extruded length (l) thereof.

2. A loose fill packing element as set forth in claim 1 wherein said central section is linear.

3. A loose fill packing element as set forth in claim 1 wherein said material has a density of less than 2 pounds per cubic foot.

4. A loose fill packing element as set forth in claim 1 wherein said material is selected from the group consisting of polystyrene, polyethylene, polypropylene and polyurethane.

5. A loose fill packing element of expandable resilient thermoplastic material, said element being of elongated shape having a central section and at least a pair of end sections splayed outwardly of said central section and on the same side, each end section extending from said central section to define an included angle of greater than 90°, said element having a transverse cross-section of substantially rectangular shape and being of a width (w) greater than the extruded length (l) thereof.

6. A loose fill packing element as set forth in claim 5 of substantially uniform width wherein each end section is of a thickness less than the thickness of said central section.

7. A loose fill packing element as set forth in claim 5 wherein said central section has a side surface disposed in a plane passing through each of said legs.

8. A loose fill packing element as set forth in claim 5 wherein each leg has a slightly rounded side surface on the side defining said included angle.

9. A loose fill free flowing packing material comprising a plurality of nesting expandable resilient thermoplastic material elements, each said element being of elongated shape having a central section and at least a pair of end sections splayed outwardly of said central section and on the same side, each said end section extending from said central section to define an included angle of greater than 90°, said element having a transverse cross-section of substantially rectangular shape and being of a width (w) greater than the extended length (l) thereof.

10. A loose fill packing material comprising a plurality of nesting expandable resilient thermoplastic material elements, each said element being of block shape having a central section and at least a pair of end sections defining a generally block C-shaped, each said end section extending from said central section to define an included angle of greater than 90°, said element having a transverse cross-section of substantially rectangular shape and being of a width (w) greater than the extruded length (l) thereof.

11. A loose fill packing element of expanded resilient thermoplastic material, said element being of generally block shape having a central section and at least a pair of end sections defining a generally block C-shape, each said end section extending from said central section to define an included angle of greater than 90°, said element having a transverse cross-section of substantially rectangular shape and being of a width (w) greater than the extruded length (l) thereof.

12. A loose fill packing element of expanded resilient thermoplastic material, said element being of elongated shape having a central section and at least a pair of end sections splayed outwardly of said central section and on the same side, each said end section extending from said central section to define an included angle of greater than 90°, said element having a transverse cross-section of substantially rectangular shape and being of a width (w) greater than the extruded length (l) thereof.

13. A loose fill packing material comprising a plurality of nesting expanded resilient thermoplastic material elements, each said element being of elongated shape having a central section and at least a pair of end sections splayed outwardly of said central section and on the same side, each said end section extending from said central section to define an included angle of greater than 90°, said element having a transverse cross-section of substantially rectangular shape and being of a width (w) greater than the extruded length (l) thereof.

14. A loose fill packing material comprising a plurality of nesting expanded resilient thermoplastic material elements, each said element being of block shape having a central section and at least a pair of end sections defining a generally block C-shape, each said end section extending from said central section to define an included angle of greater than 90°, said element having a transverse cross-section of substantially rectangular shape and being of a width (w) greater than the elongated length (l) thereof.

15. A loose fill packing element of expandable resilient thermoplastic material, said element being of generally block shape having a central section and at least a pair of end sections defining a channel shape, each said end section extending from said central section to define an included angle of greater than 90°, said element having a transverse cross-section of substantially rectangular shape and being of a width (w) greater than the extruded length (l) thereof.

16. A loose fill packing element of expandable resilient thermoplastic material, said element being of generally block shape having a central section and at least a pair of end sections, said central section and said end sections defining a channel shape, each said end section being splayed outwardly from said central section on the same side to define an included angle of greater than 90°, said element having a transverse cross-section of substantially rectangular shape and being of a width (w) greater than the extruded length (l) thereof.

* * * * *

UNITED STATES PATENT OFFICE

CERTIFICATE OF CORRECTION

Patent No. 4,027,064 Dated May 31, 1977

Inventor(s) May 31, 1977

It is certified that error appears in the above-identified patent and that said Letters Patent are hereby corrected as shown below:

Figure 1 and the drawing figure which appears on title page should appear as shown on the attached sheet.

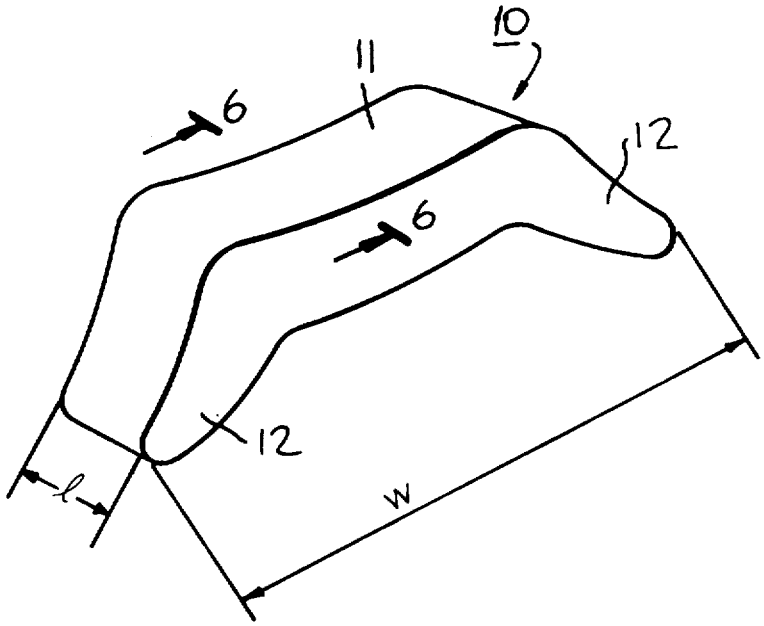

Signed and Sealed this

*Sixth* Day of *June 1978*

[SEAL]

*Attest:*

RUTH C. MASON
*Attesting Officer*

DONALD W. BANNER
*Commissioner of Patents and Trademarks*